US007856818B2

(12) United States Patent
Inoue et al.

(10) Patent No.: US 7,856,818 B2
(45) Date of Patent: Dec. 28, 2010

(54) COMPRESSOR

(75) Inventors: Yoshinori Inoue, Kariya (JP); Akinobu Kanai, Kariya (JP); Osamu Nakayama, Kariya (JP); Naoki Koeda, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 385 days.

(21) Appl. No.: 11/990,247

(22) PCT Filed: May 31, 2007

(86) PCT No.: PCT/JP2007/061076

§ 371 (c)(1),
(2), (4) Date: Feb. 8, 2008

(87) PCT Pub. No.: WO2007/142113

PCT Pub. Date: Dec. 13, 2007

(65) Prior Publication Data

US 2009/0246060 A1 Oct. 1, 2009

(30) Foreign Application Priority Data

Jun. 2, 2006 (JP) ..... 2006-154185

(51) Int. Cl.
*F04B 27/08* (2006.01)
*F25B 43/00* (2006.01)

(52) U.S. Cl. ..... 60/454; 62/470; 418/89

(58) Field of Classification Search ..... 92/154; 91/46; 60/454; 418/89; 62/470
See application file for complete search history.

(56) References Cited

U.S. PATENT DOCUMENTS 4,260,402 A * 4/1981 Shaffer et al. ..... 55/505

(Continued)

FOREIGN PATENT DOCUMENTS

EP 0899460 A2 3/1999

(Continued)

OTHER PUBLICATIONS

PCT International Search Report (PCT/2007/061076) mailed Jul. 10, 2007.

(Continued)

*Primary Examiner*—Thomas E Lazo
(74) *Attorney, Agent, or Firm*—Locke Lord Bissell & Liddell LLP

(57) ABSTRACT

A compressor having a discharge chamber into which compressed refrigerant gas is discharged, a discharge passage connected to the discharge chamber, an oil separation device that centrifugally separate oil from the refrigerant gas, an oil reservoir chamber that communicates with a separation chamber through an oil passage and retains the oil separated from the refrigerant gas, and a filter provided between the separation chamber and the oil passage is disclosed. The oil reservoir chamber communicates with a low pressure zone in the compressor the pressure of which is lower than the pressure in the discharge chamber. The oil reservoir chamber thus supplies the separated oil to the low pressure zone. The oil separation device is arranged in the discharge passage in such a manner as to define the separation chamber. The oil separation device centrifugally separate the oil from the refrigerant gas by causing swirling of the refrigerant gas that has been sent to the separation chamber. The filter extends in a swirling direction of the refrigerant gas in the separation chamber.

9 Claims, 7 Drawing Sheets

U.S. PATENT DOCUMENTS

| | | | | |
|---|---|---|---|---|
| 6,152,713 | A * | 11/2000 | Hisanaga et al. | 418/55.2 |
| 7,207,185 | B2 | 4/2007 | Ota et al. | 62/193 |

FOREIGN PATENT DOCUMENTS

| | | |
|---|---|---|
| JP | 55-46538 | 3/1980 |
| JP | 06-010835 | 1/1994 |
| JP | 11-082338 | 3/1999 |
| JP | 2004-036583 | 2/2004 |
| JP | 2004-196028 | 7/2004 |
| JP | 2005-120970 | 5/2005 |
| JP | 2007-162621 | 6/2007 |

OTHER PUBLICATIONS

International Preliminary Report on Patentability mailed on Jan. 22, 2009 for International Application No. PCT/JP2007/061076.

* cited by examiner

COMPRESSOR

FIELD OF THE INVENTION

The present invention relates to a swash plate type compressor that is used, for example, in an air conditioner of a vehicle and has a filter that removes foreign particles from oil that has been separated from discharge gas.

BACKGROUND OF THE INVENTION

Patent Document 1 discloses a compressor having an oil separator that separates oil from refrigerant gas and is arranged in a rear housing. The oil separator is connected to a discharge chamber through a discharge passage.

An oil separation chamber having a cylindrical oil separation device is provided in an upper portion of the oil separator. The oil separation device extends in a vertical direction. An oil reservoir chamber is defined below the oil separation chamber to retain oil that has been separated by the oil separation device. A flat filter is arranged between the oil separation chamber and the oil reservoir chamber and extends along a plane perpendicular to the axis of the oil separation chamber, that is, along a horizontal plane.

After having been sent to the oil separation chamber through the discharge passage, the refrigerant gas swirls downward about the axis of the oil separation device in the space between the oil separation device and the inner circumferential wall of the oil separation chamber. This separates oil from the refrigerant gas. As the oil passes through the filter, foreign particles are removed from the oil. The oil is then retained in the oil reservoir chamber. After such separation, the refrigerant gas flows through a refrigerant gas passage defined in the oil separation device and is discharged to an external refrigerant circuit. The oil is returned from the oil reservoir chamber to a suction chamber through an oil return bore.

In the technique of Patent Document 1, the oil that has been separated from the refrigerant gas in the oil separation chamber passes through the filter while flowing downward. The oil is thus retained in the oil reservoir chamber after foreign particles have been removed. However, the filter is flat and arranged horizontally in such a manner that a surface of the filter faces the oil separation device. Thus, the foreign particles removed from the oil are deposited on the filter. This causes clogging of the filter early, increasing the frequency of replacement of the filter. Further, the oil reservoir chamber is provided below the oil separation chamber and the filter is arranged between the oil separation chamber and the oil reservoir chamber. This arrangement restricts the position of the oil reservoir chamber and reduces the size of the space for the oil reservoir chamber.

Patent Document 1: Japanese Laid-Open Patent Publication No. 2004-196082

SUMMARY OF THE INVENTION

Accordingly, it is an objective of the present invention to provide a compressor capable of suppressing clogging of a filter and saving sufficient space for an oil reservoir chamber.

To achieve the foregoing objective, a compressor that compresses refrigerant gas containing oil is provided. The compressor includes a discharge chamber into which the compressed refrigerant gas is discharged, a discharge passage connected to the discharge chamber, an oil separation device, an oil reservoir chamber, and a filter. The oil separation device is provided in the discharge passage in such a manner as to define a separation chamber in the discharge passage and centrifugally separate the oil from the refrigerant gas by causing the refrigerant gas that has been introduced into the separation chamber to swirl. The oil reservoir chamber communicates with the separation chamber through an oil passage and retains the oil separated from the refrigerant gas in the separation chamber. The oil reservoir chamber communicates with a low pressure zone in the compressor the pressure of which is lower than the pressure in the discharge chamber. The filter is provided between the separation chamber and the oil passage and extends along a swirling direction of the refrigerant gas in the separation chamber.

DETAILED DESCRIPTION OF THE PREFERRED EMBODIMENTS

A swash plate type variable displacement compressor (hereinafter, referred to simply as a compressor) according to a first embodiment of the present invention will now be described with reference to FIGS. 1 to 3.

Figure 1:
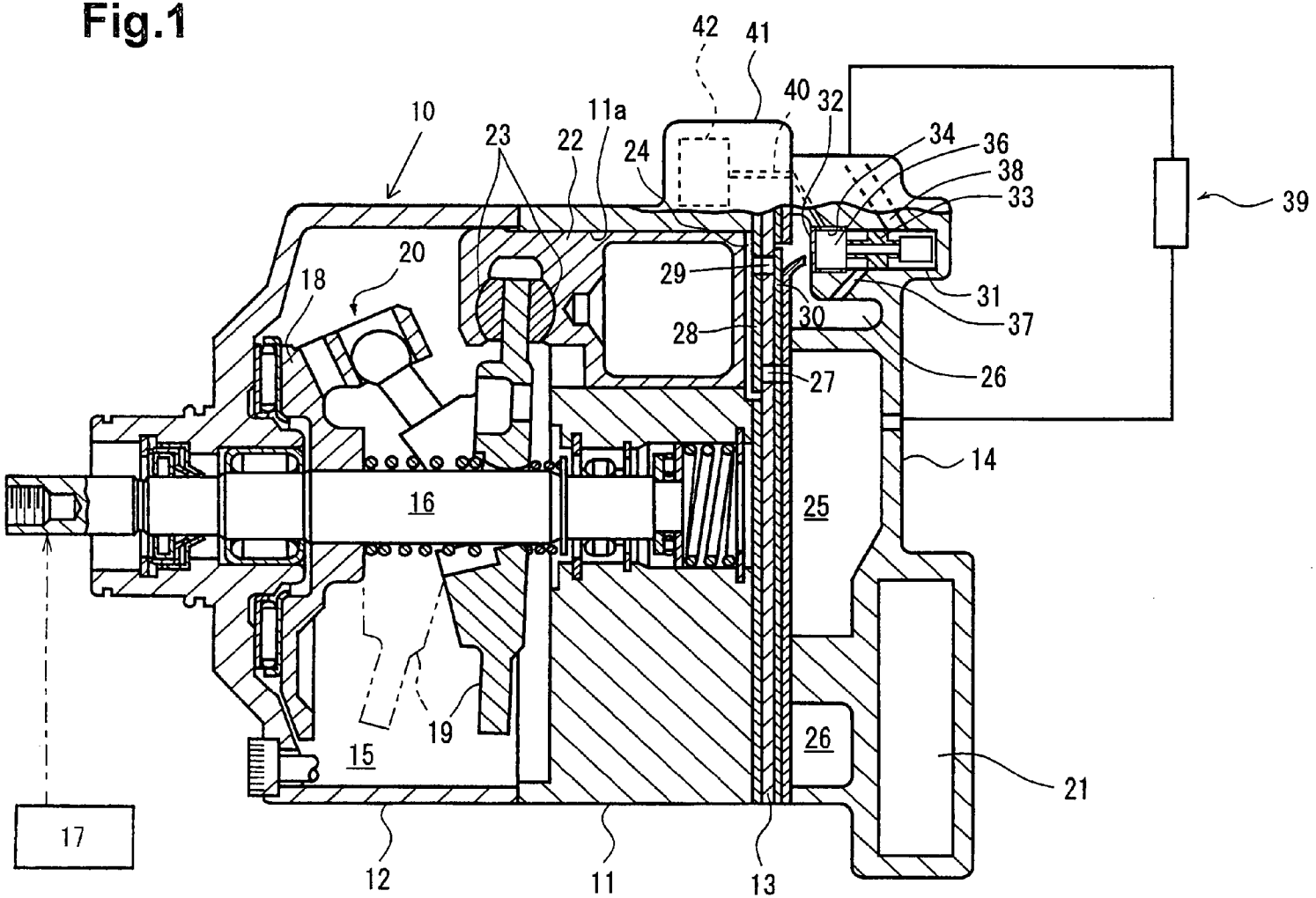
FIG. 1 is a longitudinal cross-sectional view showing a compressor according to a first embodiment of the present invention.

As shown in FIG. 1, a housing of a compressor 10 includes a cylinder block 11, a front housing member 12 joined to the front end of the cylinder block 11, and a rear housing member 14 joined to the rear end of the cylinder block 11 through a valve/port forming member 13. A crank chamber 15 is provided in the area surrounded by the cylinder block 11 and the front housing member 12. A drive shaft 16 is arranged in the crank chamber 15 in a manner rotatable about the axis of the drive shaft 16. The drive shaft 16 is operably connected to an engine 17 mounted in a vehicle and rotated by the power supplied by the engine 17.

In the crank chamber 15, a lug plate 18 is fixed to the drive shaft 16 in a manner rotatable integrally with the drive shaft 16. The crank chamber 15 accommodates a swash plate 19. The swash plate 19 is supported by the drive shaft 16 in a manner slidable on the drive shaft 16 along the axis of the drive shaft 16 and inclinable with respect to the drive shaft 16. A hinge mechanism 20 is arranged between the lug plate 18 and the swash plate 19. The swash plate 19 is rotatable synchronously with the lug plate 18 and the drive shaft 16 through the hinge mechanism 20. The swash plate 19 is also inclinable when the drive shaft 16 axially moves. The inclination angle of the swash plate 19 is adjusted by a displacement control valve 21.

A plurality of cylinder bores 11*a* are defined in the cylinder block 11 (only a single cylinder bore 11*a* is shown in FIG. 1). A single-headed piston 22 is received in each of the cylinder bores 11*a* so as to reciprocate. Each of the pistons 22 is engaged with the outer circumferential portion of the swash plate 19 through a pair of shoes 23. Thus, rotation of the drive shaft 16 rotates the swash plate 19, and rotation of the swash plate 19 is converted into linear reciprocation of the pistons 22 through the shoes 23. A compression chamber 24, which is surrounded by the pistons 22 and the valve/port forming member 13, is provided at the backsides (the right sides as viewed in FIG. 1) of the cylinder bores 11*a*.

A suction chamber 25 is defined in the rear housing member 14. A discharge chamber 26 is provided around the suction chamber 25. When each of the pistons 22 moves from the top dead center to the bottom dead center, the refrigerant gas is sent from the suction chamber 25 to the compression chamber 24 through suction ports 27 and suction valves 28 provided in the valve/port forming member 13. The refrigerant gas is compressed to a predetermined level of pressure in the compression chamber 24 as the pistons 22 move from the bottom dead center to the top dead center. The refrigerant gas is then discharged into the discharge chamber 26 through discharge ports 29 and discharge valves 30 defined in the valve/port forming member 13.

Figure 2:
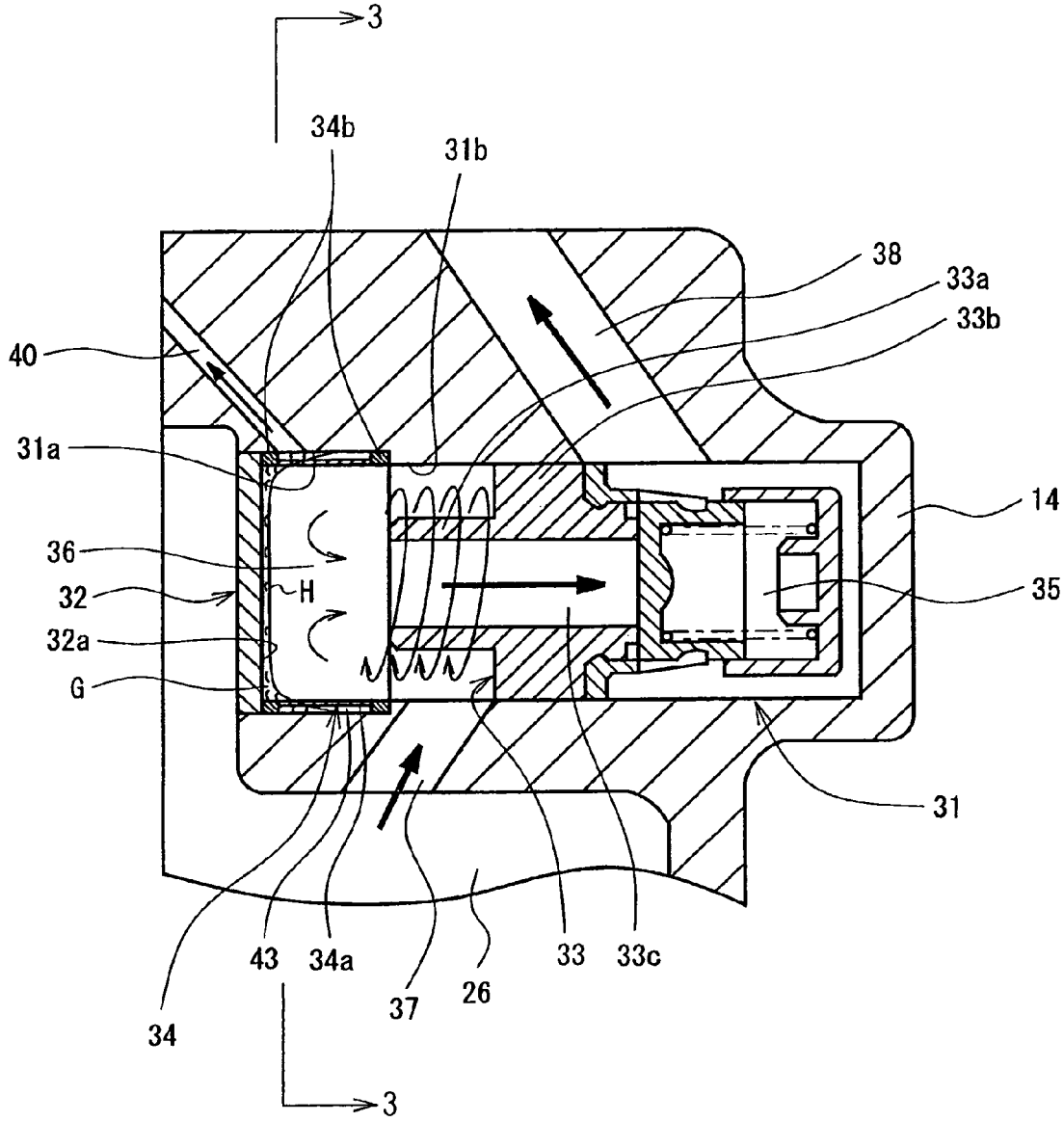
FIG. 2 is an enlarged cross-sectional view showing a main portion of the compressor shown in FIG. 1.
Figure 3:
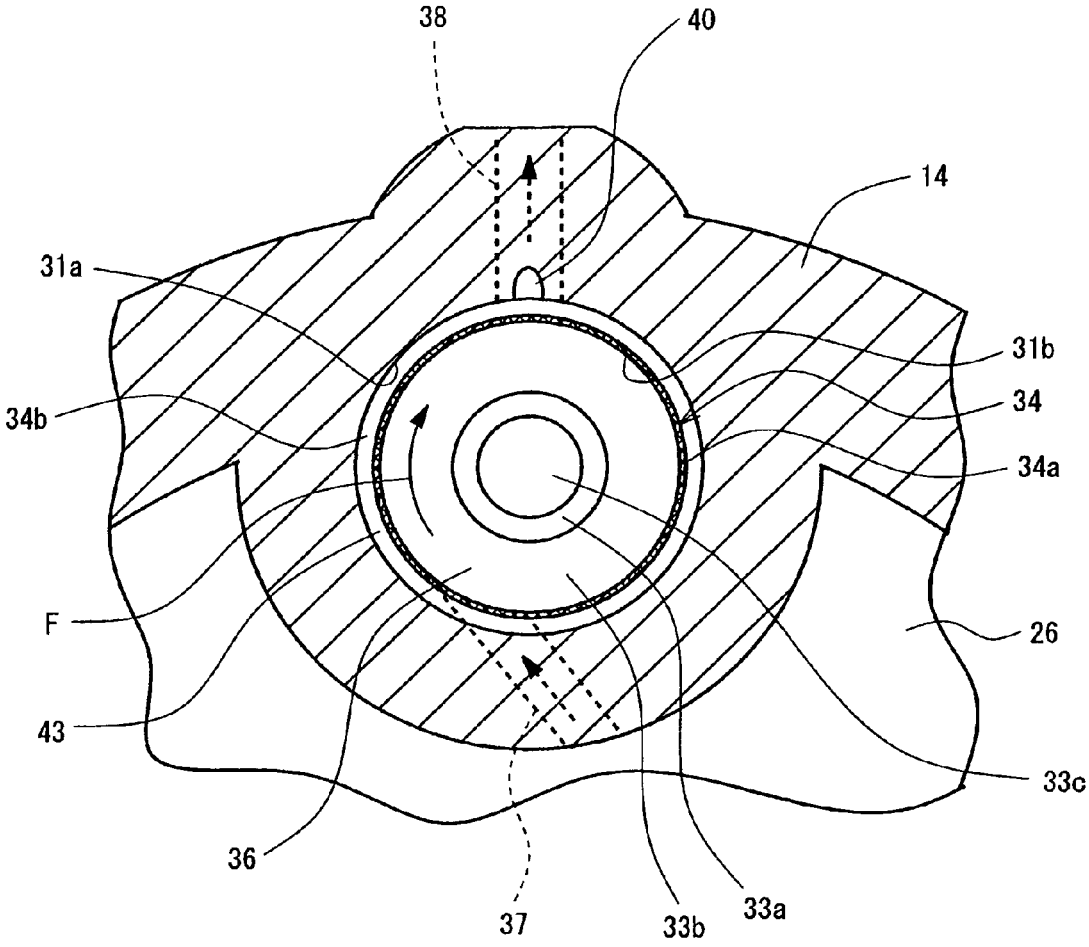
FIG. 3 is an enlarged cross-sectional view taken along line 3-3 of FIG. 2.

As shown in FIGS. 1 and 2, a cylindrical bore 31 having an inner bottom surface is provided in an upper portion of the rear housing member 14 in such a manner as to communicate with the discharge chamber 26. The cylindrical bore 31 defines a discharge passage provided in the discharge chamber 26. The cylindrical bore 31 extends parallel with the axis of the drive shaft 16. Referring to FIG. 2, a large diameter bore 31*a* having a diameter greater than the diameter of the cylindrical bore 31 is provided at an inlet, or the left opening as viewed in FIG. 2, of the cylindrical bore 31. This forms a stepped portion in an inner wall surface 31*b* of the cylindrical bore 31. A cylindrical oil separation device 33 is formed at the axial center of the cylindrical bore 31. With a cylindrical portion 33*a* facing forward, a seat 33*b* of the oil separation device 33, the diameter of which is greater than the diameter of the cylindrical portion 33*a*, is press fitted into the cylindrical bore 31. This fixes the oil separation device 33 to the inner wall surface 31*b* of the cylindrical bore 31. A gas passage 33*c* is defined in the oil separation device 33 and extends along the axis of the oil separation device 33.

The space located forward of the oil separation device 33 in the cylindrical bore 31 defines a separation chamber 36.

A cylindrical filter 34 is secured to the wall of the large diameter bore 31*a*. The filter 34 has a cylindrical mesh member 34*a* and annular holding members 34*b*, which hold the axial ends of the mesh member 34*a*. The holding members 34*b* is press fitted into the large diameter bore 31*a*, thus fixing the filter 34 to the inner wall surface 31*b* of the cylindrical bore 31. When the filter 34 is held in a secured state, a narrow gap 43 is defined between the mesh member 34*a* and the inner wall surface 31*b* of the cylindrical bore 31 (the large diameter bore 31*a*), or between the mesh member 34*a* and the inner circumferential surface of the separation chamber 36. Each of the meshes of the mesh member 34*a* is sized optimally to remove foreign particles from oil G.

A disk-like lid 32, which separates the discharge chamber 26 from the separation chamber 36, is secured to the front side of the filter 34 in the large diameter bore 31*a*. The lid 32 is fixed to the inner wall surface 31*b* through press fitting of the outer circumferential portion of the lid 32 into the large diameter bore 31*a*. The space surrounded by the oil separation device 33, the inner wall surface 31*b* of the cylindrical bore 31, and the lid 32 defines the separation chamber 36.

A check valve 35, which is located adjacent to the oil separation device 33, is accommodated in a portion of the cylindrical bore 31 rearward (rightward as viewed in FIG. 2) from the axial center of the cylindrical bore 31. The check valve 35 prevents backflow of refrigerant from an external refrigerant circuit 39 to the discharge chamber 26.

The discharge chamber 26 communicates with the separation chamber 36 through an inlet passage 37. The inlet passage 37 thus introduces the refrigerant gas from the discharge chamber 26 to the separation chamber 36. The inlet passage 37 has an opening in the separation chamber 36 at a position opposed to the cylindrical portion 33*a* of the oil separation device 33. The refrigerant gas is thus sent to the area around the cylindrical portion 33*a*. As shown in FIG. 3, the inlet passage 37 is defined in such a manner that the flow line of the refrigerant gas introduced into the separation chamber 36 becomes substantially parallel with a tangential line of a circular lateral cross section of the inner wall surface 31*b* of the cylindrical bore 31 (the separation chamber 36). Thus, after having been sent to the separation chamber 36 through the inlet passage 37, the refrigerant gas swirl along the inner wall surface 31*b* in a clockwise direction (the direction indicated by arrow F).

Through such swirling of the refrigerant gas along the inner wall surface 31*b* in the annular space between the inner wall surface 31*b* and the cylindrical portion 33*a* of the oil separation device 33, the oil G contained in the refrigerant gas is centrifugally separated from the refrigerant gas in the separation chamber 36. After such separation of the oil G, the refrigerant gas flows from the separation chamber 36 to a gas passage 33*c* in the oil separation device 33 and is thus sent to the check valve 35. The refrigerant gas then passes through the discharge passage 38 and is discharged into the external refrigerant circuit 39.

An oil passage 40 communicates with the large diameter bore 31*a* at a position rearward of the lid 32. Thus, the filter 34 extending along a swirling direction F of the refrigerant gas in the separation chamber 36, or the cylindrical filter 34, is arranged between the separation chamber 36 and the oil passage 40.

The oil G that has been separated from the refrigerant gas is retained in the vicinity of a backside 32*a* of the lid 32 in the separation chamber 36. The retained oil G then passes through the filter 34 and flows into the oil passage 40.

With reference to FIG. 1, a projection 41 projects outward from the upper surface of the cylinder block 11. An oil reservoir chamber 42 for retaining the oil G is defined in the projection 41. The oil reservoir chamber 42 and the separation chamber 36 communicate with each other through the oil passage 40. The oil reservoir chamber 42 communicates with the crank chamber 15, which is a low pressure zone, through a non-illustrated oil return passage including a restriction.

Operation of the compressor 10, which is configured as above-described, will hereafter be explained.

First, the refrigerant gas in a compressed state is discharged from the discharge chamber 26. The refrigerant gas then flows into the separation chamber 36 through the inlet passage 37. The refrigerant gas flows toward the distal end of the cylindrical portion 33*a* in the separation chamber 36 while swirling along the inner wall surface 31*b* in the annular space between the inner wall surface 31*b* and the cylindrical portion 33*a* of the oil separation device 33. This centrifugally separates the oil contained in the refrigerant gas in a mist form from the refrigerant gas.

While continuously swirling, the refrigerant gas proceeds forward after having passed the distal end of the cylindrical portion 33*a*. Some of the refrigerant gas thus strikes the backside 32*a* of the lid 32. The cylindrical filter 34, which extends along the swirling axis of the refrigerant gas in the separation chamber 36, is provided between the lid 32 and the oil separation device 33. Thus, as the refrigerant gas hits and passes through the filter 34 while swirling, the oil is further separated from the refrigerant gas.

After the oil G has been removed, the refrigerant gas flows from the distal end of the cylindrical portion 33*a* of the oil separation device 33 to the gas passage 33*c* and is thus introduced into the check valve 35. The refrigerant gas is then sent from the check valve 35 to the external refrigerant circuit 39 through the discharge passage 38.

The oil G that has been separated by the oil separation device 33 and the filter 34 exhibits oil distribution H as illustrated in FIG. 2. Specifically, the amount of the oil G adhered to the backside 32*a* of the lid 32 increases toward the inner wall surface 31*b*. In other words, the oil G is distributed on the backside 32*a* of the lid 32 in a shape indented about the axis of the cylindrical bore 31. The separated oil G is influenced by swirling of the refrigerant gas and flows along the inner wall surface 31*b* of the large diameter bore 31*a*.

The separation chamber 36 and the oil reservoir chamber 42 communicate with each other through the oil passage 40. The oil reservoir chamber 42 communicates with the crank chamber 15, or the low pressure zone, through the non-illustrated oil return passage. Thus, with respect to the oil separation chamber 36, which is a high pressure zone retaining compressed refrigerant gas at high pressure, the oil reservoir chamber 42 is an intermediate pressure zone, which is exposed to a pressure intermediate between the pressure in the low pressure zone and the pressure in the high pressure zone. The difference between the pressure in the oil separation chamber 36 and the pressure in the oil reservoir chamber 42 causes the oil G to flow from the oil separation chamber 36 to the oil reservoir chamber 42 through the oil passage 40.

At this stage, the filter 34, which is arranged between the oil separation chamber 36 and the oil passage 40, removes foreign particles the sizes of which are greater than the size of each mesh of the mesh member 34*a*. Foreign particles, which have been separated by the filter 34, are influenced by swirling of the refrigerant gas and move on the filter 34 along the filter 34 having the cylindrical shape, without staying at a single position on the filter 34. This suppresses clogging of the filter 34 by foreign particles. The gap 43 defined between the filter 34 and the inner wall surface 31*b* of the large diameter bore 31*a* functions as a reservoir portion that temporarily retains the oil G. The gap 43 thus prevents the foreign particles from being concentrated near the inlet of the oil passage 40. Even if the foreign particles collect near the inlet of the oil passage 40, the oil G is sent to the oil passage 40 through the gap 43.

The oil G retained in the oil reservoir chamber 42 is returned to the crank chamber 15 through the non-illustrated oil return passage and lubricates sliding components of the compressor.

The illustrated embodiment, which has been described in detail, has the following advantages.

(1) The filter 34 shaped in correspondence with the swirling direction F of the refrigerant gas in the separation chamber 36 is provided between the separation chamber 36 and the oil passage 40. The refrigerant gas thus hits the filter 34 while swirling, allowing further separation of the oil from the refrigerant gas. In other words, the oil is separated from the refrigerant gas by the filter 34, additionally to the oil separation device 33. This improves separation efficiency of the oil.

(2) The separated oil G, which is retained in the separation chamber 36 in a state exhibiting distribution H illustrated in FIG. 2, flows to the oil reservoir chamber 42 through the oil passage 40. At this stage, the cylindrical filter 34, which is arranged between the separation chamber 36 and the oil passage 40, removes the foreign particles that are larger in size than each mesh of the mesh member 34*a* from the oil G. The foreign particles, which have been separated by the filter 34, are influenced by swirling of the refrigerant gas and move on the filter 34 along the filter 34 without stopping at a single position on the filter 34. This suppresses clogging of the filter 34 by the foreign particles.

(3) The filter 34 is provided not in the oil reservoir chamber 42 but in the separation chamber 36. This makes it unnecessary to perform machining for mounting the filter 34 in the oil reservoir chamber 42. Also, sufficient space is saved for the oil reservoir chamber 42.

(4) The cylindrical filter 34 is inserted into the large diameter bore 31*a* from the side corresponding to the discharge chamber 26 and thus secured to the wall of the separation chamber 36. This facilitates the machining and securing involved. Further, the filter 34 is fixed by the large diameter bore 31*a* and the lid 32. This prevents the filter 34 from coming off the wall of the separation chamber 36 through a simple structure.

(5) Since the filter 34 has a cylindrical shape, the filter 34 has a large specific surface area compared to a flat filter. This decreases the size of the filter 34 and prolongs the life of the filter 34.

(6) The gap 43 is defined between the filter 34 and the inner wall surface 31*b* of the large diameter bore 31*a*. The gap 43 is used as the reservoir portion that temporarily retains the oil. This prevents the foreign particles from being concentrated near the inlet of the oil passage 40. Even if the foreign particles are concentrated near the inlet of the oil passage 40, the oil G is introduced into the oil passage 40 through the gap 43.

A second embodiment of the present invention will hereafter be explained with reference to FIG. 4.

In the second embodiment, the cylindrical bore 31 of the first embodiment is oriented in a different manner. The other portions of the second embodiment are configured identically with the corresponding portions of the first embodiment. Thus, in the following, some of the reference numerals used for the first embodiment will be used commonly for the second embodiment in order to facilitate understanding. The description of the portions of the second embodiment that are common with the corresponding portions of the first embodiment will be omitted and only the portions modified from the first embodiment will be described.

Figure 4:
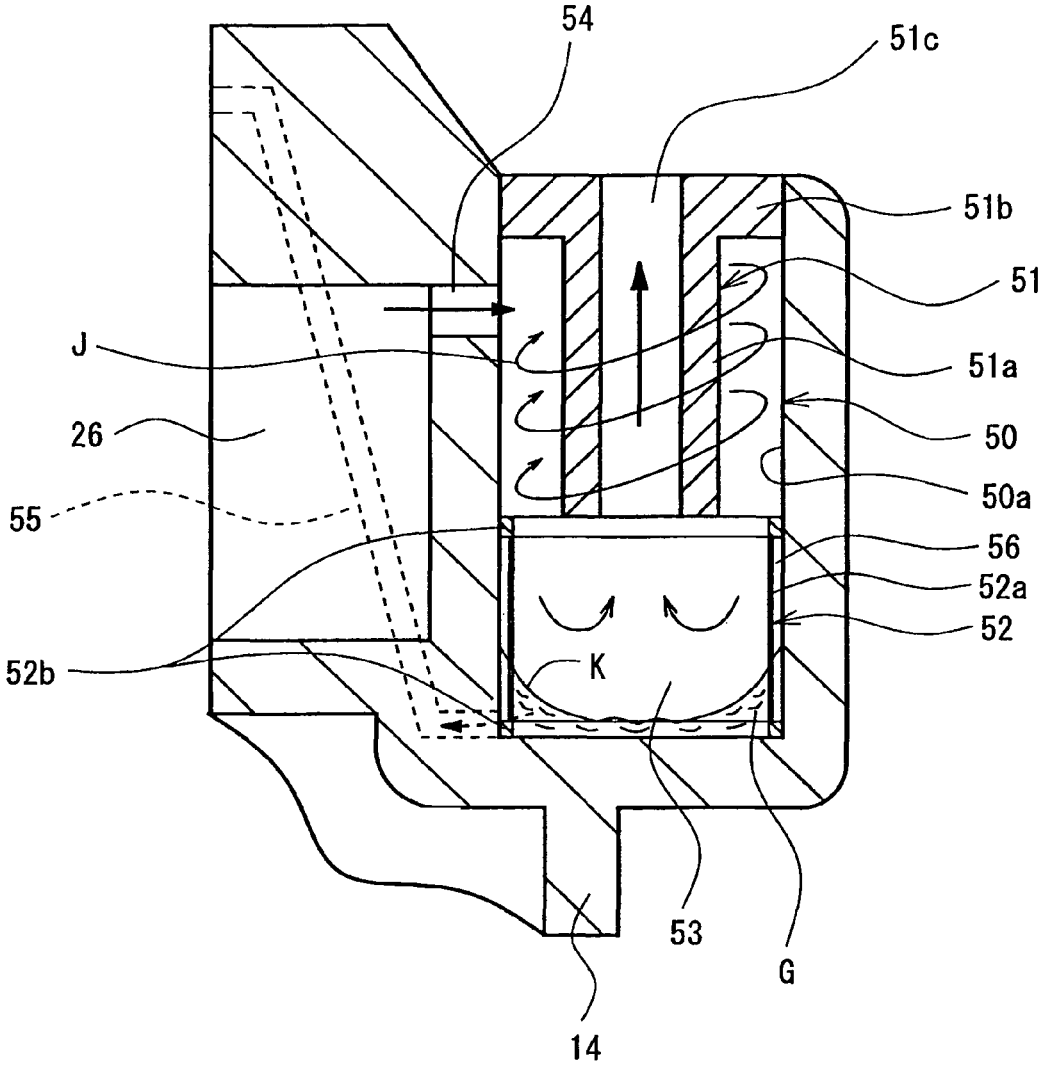
FIG. 4 is an enlarged cross-sectional view showing a main portion of a compressor according to a second embodiment of the present invention.

As shown in FIG. 4, a cylindrical bore 50 forming a discharge passage is defined in the rear housing member 14 at a position rearward of the discharge chamber 26. The cylindrical bore 50 extends perpendicular to the axis of the drive shaft 16 and in a vertical direction. The cylindrical bore 50 has an opening at the upper end of the cylindrical bore 50. A cylindrical oil separation device 51 is arranged in an upper portion of the cylindrical bore 50. The oil separation device 51 has a seat 51*b* and a cylindrical portion 51*a* extending downward from the seat 51*b*. The seat 51*b*, the diameter of which is greater than the diameter of the cylindrical portion 51*a*, is press fitted into the cylindrical bore 50 with the cylindrical portion 51*a* faced downward. This fixes the oil separation device 51 to an inner wall surface 50*a* of the cylindrical bore 50. A gas passage 51*c* is defined in the oil separation device 51 and extends along the axial direction of the oil separation device 51, or in an up-and-down direction.

The space surrounded by the inner wall surface 50*a* and the oil separation device 51 forms a separation chamber 53. The discharge chamber 26 and the separation chamber 53 communicate with each other through an inlet passage 54. The refrigerant gas is sent from the discharge chamber 26 to the separation chamber 53 through the inlet passage 54. The inlet passage 54 opens to the separation chamber 53 at a position opposed to the cylindrical portion 51*a* in such a manner that the refrigerant gas is introduced to the area around the cylindrical portion 51*a* of the oil separation device 51. After having reached the separation chamber 53 through the inlet passage 54, the refrigerant gas flows downward along the inner wall surface 50*a* while swirling in direction J.

A cylindrical filter 52 is secured to and extends along the inner wall surface 50*a* of the separation chamber 53 at a position below the oil separation device 51 in the separation chamber 53. The filter 52 has a cylindrical mesh member 52*a* and an annular holding member 52*b*, which holds the two axial ends of the mesh member 52*a*. The holding member 52*b* is press fitted into the cylindrical bore 50 to fix the filter 52 to the inner wall surface 50*a*. When the filter 52 is in a secured state, a narrow gap 56 is defined between the mesh member 52*a* and the inner wall surface 50*a*.

An oil passage 55, which communicates with a non-illustrated oil reservoir chamber, has an opening at a lower position of the separation chamber 53. The filter 52, which is shaped in correspondence with swirling direction J of the refrigerant gas in the separation chamber 53, or has a cylindrical shape, is arranged between the oil passage 55 and the separation chamber 53.

After having been introduced into the separation chamber 53 through the inlet passage 54, the refrigerant gas flows downward while swirling in the annular space between the cylindrical portion 51*a* of the oil separation device 51 and the inner wall surface 50*a* of the cylindrical bore 50. This centrifugally separates the oil G from the refrigerant gas. The separated oil G then deposits on the bottom surface of the separation chamber 53. Also, while flowing downward in a swirling manner, the refrigerant gas strikes the filter 52 and passes through the filter 52. This removes the oil from the refrigerant gas.

The separated oil G exhibits distribution K. Specifically, the amount of the oil G deposited on the bottom surface of the separation chamber 53 becomes greater toward the inner wall surface 50*a*. In other words, the oil G is distributed on the bottom surface of the separation chamber 53 in a shape indented about the axis of the cylindrical bore 50. The separated oil G is influenced by swirling of the refrigerant gas and thus flows along the inner wall surface 50*a* of the cylindrical bore 50.

After the oil is removed, the refrigerant gas passes through the gas passage 51*c* of the oil separation device 51 and is discharged into the external cooling circuit. Further, the oil G deposited on the bottom surface of the separation chamber 53 flows into the oil reservoir chamber through the oil passage 55 and is retained in the oil reservoir chamber. The cylindrical filter 52, which is located between the separation chamber 53 and the oil passage 55, operates in the same manner as that of the first embodiment and detailed description thereof is omitted herein.

As has been described in detail, the second embodiment has the following advantages in addition to the advantages (1) to (3), (5), and (6) of the first embodiment.

(7) The cylindrical filter 52 is inserted into the cylindrical bore 50 from the upper opening of the cylindrical bore 50 and thus mounted in the cylindrical bore 50. This facilitates the machining and securing involved.

(8) Some of the foreign particles collected by the filter 52 are separated from the filter 52 by means of the refrigerant gas swirling in the separation chamber 53. Further, the oil separation device 51 has the opening of the gas passage 51*c* at the upper end of the oil separation device 51. This prevents the separated foreign particles from falling downward due to the own weight and flowing to the external refrigerant circuit.

The present invention is not restricted to the above illustrated embodiments and may be modified in various forms without departing from the scope of the invention. The invention may be modified as follows, for example.

Figure 5:
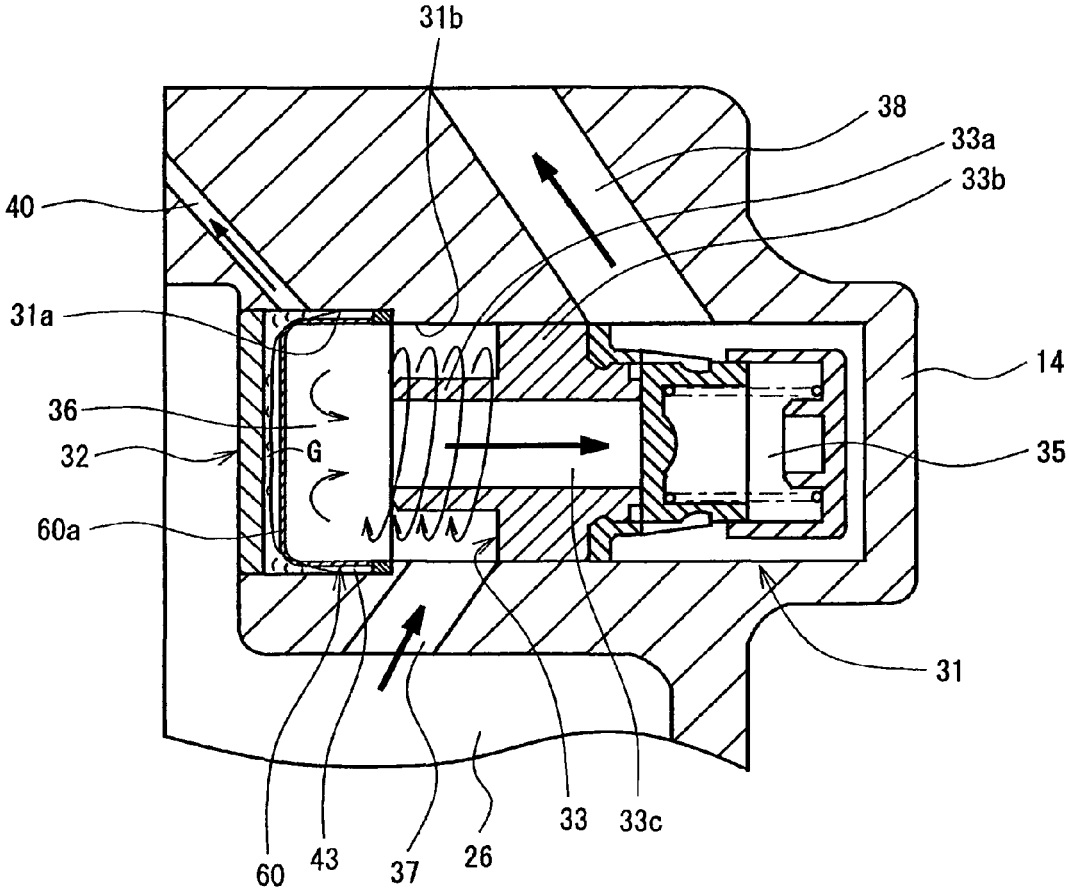
FIG. 5 is an enlarged cross-sectional view showing a main portion of a compressor according to a first modified embodiment.

Although the filters 34, 52 have cylindrical shapes in the first and second embodiments, one end of each filter 34, 52 may be closed. With reference to FIG. 5, a mesh member 60*a* of a filter 60 has a cylindrical portion extending along the inner wall surface 31*b* of the cylindrical bore 31 and a flat bottom arranged at an axial end of the cylindrical portion. The cylindrical portion and the bottom are formed continuously from each other. The flat bottom of the filter 60, which is provided additionally to the cylindrical portion, increases the contact area of the oil G separated from the refrigerant gas with respect to the filter 60. This improves the efficiency of separation of the oil G from the refrigerant gas and the efficiency of removal of the foreign particles from the oil G. The life of the filter 60 is also prolonged. The cylindrical portion of the filter 60 may be inclined with respect to the inner wall surface 31*b*. The flat bottom of the filter 60 does not necessarily have to extend perpendicularly to the inner wall surface 31*b*.

Figure 6:
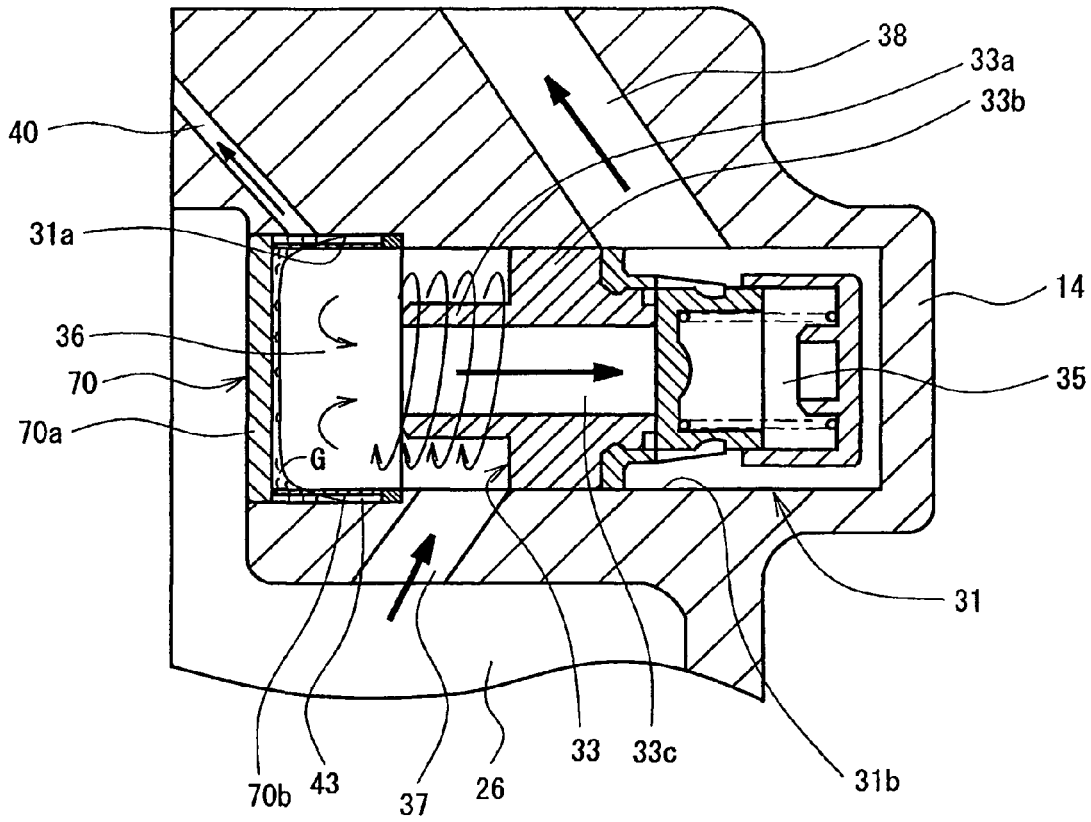
FIG. 6 is an enlarged cross-sectional view showing a main portion of a compressor according to a second modified embodiment.

In the first embodiment, the lid 32, which separates the separation chamber 36 and the discharge chamber 26 from each other, is provided separately from the filter 34. However, the lid 32 and the filter 34 may be formed as an integral body. As shown in FIG. 6, a lid 70 is formed as an integral body including a lid portion 70*a* and a filter portion 70*b* fixed to the lid portion 70*a*. The lid 70 is press fitted into the large diameter bore 31*a* of the cylindrical bore 31 and thus fixed. Since the lid portion 70*a* and the filter portion 70*b* are formed integrally with each other, the number of the components and the number of the assembly steps are decreased.

Figure 7:
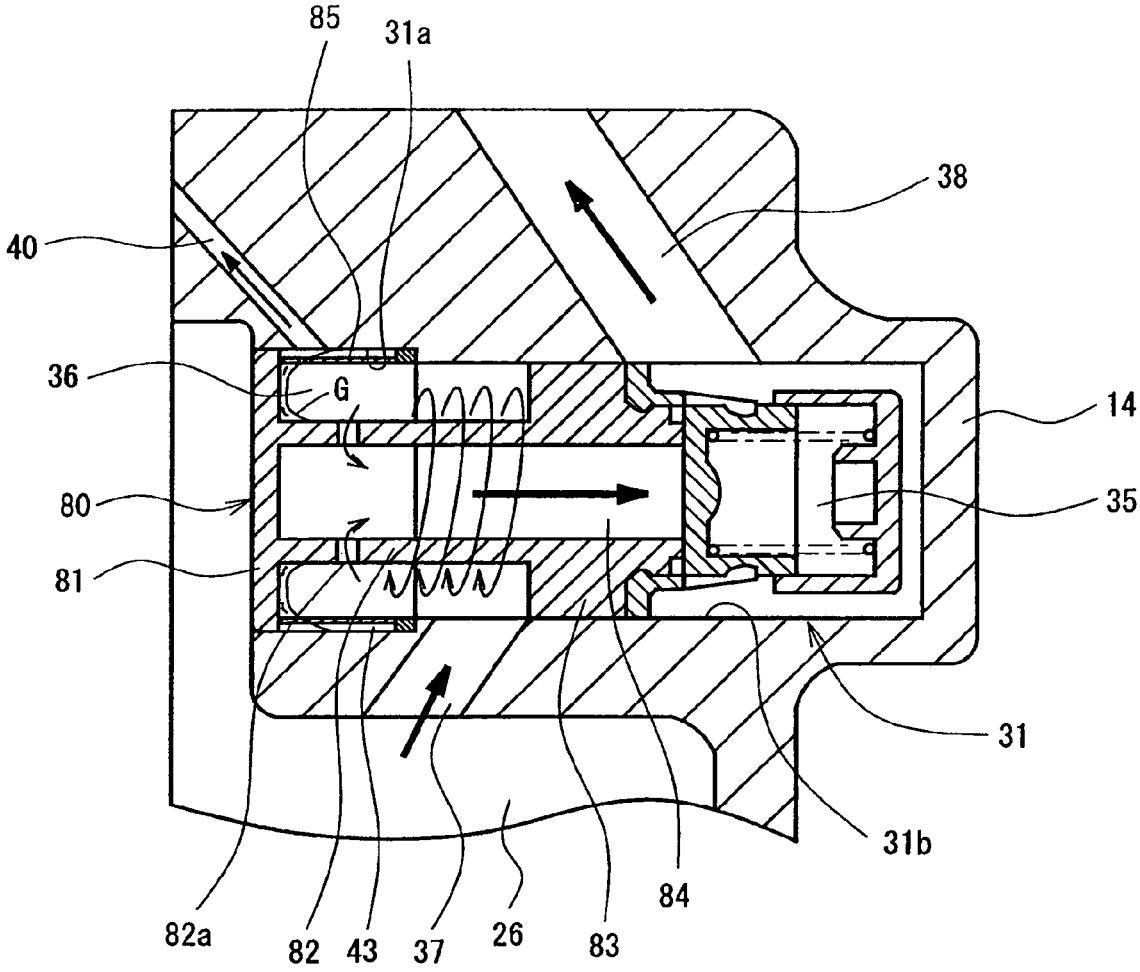
FIG. 7 is an enlarged cross-sectional view showing a main portion of a compressor according to a third modified embodiment.

In the first embodiment, the lid 32 and the oil separation device 33 may be formed as an integral body. With reference to FIG. 7, an oil separation device 80 includes a lid 81, a cylindrical portion 82, and a seat 83. The lid 81 corresponds to the lid 32 of the first embodiment. The cylindrical portion 82 and the seat 83 correspond to the oil separation device 33 of the first embodiment. The seat 83 is press fitted into the cylindrical bore 31 and the lid 81 is press fitted into the large diameter bore 31*a*. This fixes the oil separation device 80 to the inner wall surface 31*b*. A gas passage 84 is defined in the oil separation device 80 and extends in the axial direction of the oil separation device 80. The gas passage 84 has an opening that faces rearward. The annular space between the outer circumferential surface of the cylindrical portion 82 and the inner wall surface 31*b* of the cylindrical bore 31 defines the separation chamber 36. The separation chamber 36 and the gas passage 84 communicate with each other through a communication bore 82*a* defined in the cylindrical portion 82. A cylindrical filter 85 is provided between the separation chamber 36 and the oil passage 40. The cylindrical filter 85 may be formed separately from or integrally with the oil separation device 80.

The tube-like filter 34, 52 does not necessarily have to have a circular cross-sectional shape but may have, for example, an oval cross-sectional shape or a polygonal cross-sectional shape.

In the first and second embodiments, the compressor 10 has been described as a swash plate type variable displacement compressor. However, the compressor 10 may be a fixed displacement type or a wobble plate type. Alternatively, the compressor 10 is not restricted to the swash plate type but may be a scroll type or a vane type.

Although the oil reservoir chamber 42 is located upward of the separation chamber 36 in the first and second embodiments, the reservoir chamber 42 may be arranged beside or downward of the separation chamber 36. That is, the oil reservoir chamber 42 may be provided at an optimal position selected in accordance with the layout of the compressor.

The invention claimed is:

1. A compressor that compresses refrigerant gas containing oil, the compressor comprising:

a discharge chamber into which the compressed refrigerant gas is discharged;

a discharge passage connected to the discharge chamber;

an oil separation device that is provided in the discharge passage in such a manner as to define a separation chamber in the discharge passage and centrifugally separate the oil from the refrigerant gas by causing the refrigerant gas that has been introduced into the separation chamber to swirl, wherein the separation chamber has a cylindrical shape;

an oil reservoir chamber that communicates with the separation chamber through an oil passage and retains the oil separated from the refrigerant gas in the separation chamber, wherein the oil reservoir chamber communicates with a low pressure zone in the compressor the pressure of which is lower than the pressure in the discharge chamber; and a filter that is provided between the separation chamber and the oil passage and extends along a swirling direction of the refrigerant gas in the separation chamber, wherein the filter is arranged along an inner wall surface of the cylindrical separation chamber.

2. The compressor according to claim 1, wherein the discharge passage is defined by a cylindrical bore extending along the axis of a drive shaft of the compressor, wherein the compressor further includes a lid that is mounted in the cylindrical bore and separates the separation chamber from the discharge chamber and an inlet passage through which the refrigerant gas flows from the discharge chamber to the separation chamber.

3. The compressor according to claim 2, wherein a stepped portion is formed in an inner circumferential surface of the separation chamber, wherein the filter is provided between the stepped portion and the lid.

4. The compressor according to claim 2, wherein the lid and the filter are formed integrally with each other.

5. The compressor according to claim 1, wherein the cylindrical bore extends perpendicularly to the axis of the drive shaft and in a vertical direction, and has an opening defined at an upper end of the cylindrical bore.

6. The compressor according to claim 1, wherein the filter has a cylindrical shape.

7. The compressor according to claim 1, wherein the filter has a cylindrical shape extending in an axis of the swirling of the refrigerant gas in the separation chamber.

8. The compressor according to claim 1, wherein a gap is defined between the filter and the inner circumferential surface of the separation chamber opposed to the filter.

9. The compressor according to claim 8, wherein the oil passage has an opening in the inner circumferential surface of the separation chamber.

* * * * *